US010720714B1

(12) United States Patent
Shamblin et al.

(10) Patent No.: US 10,720,714 B1
(45) Date of Patent: Jul. 21, 2020

(54) BEAM SHAPING TECHNIQUES FOR WIDEBAND ANTENNA

(71) Applicant: ETHERTRONICS, INC., San Diego, CA (US)

(72) Inventors: Jeffrey Shamblin, San Marcos, CA (US); Laurent Desclos, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 732 days.

(21) Appl. No.: 14/197,187

(22) Filed: Mar. 4, 2014

Related U.S. Application Data

(60) Provisional application No. 61/772,434, filed on Mar. 4, 2013.

(51) Int. Cl.
*H01Q 19/185* (2006.01)
*H01Q 19/10* (2006.01)

(52) U.S. Cl.
CPC ..... *H01Q 19/185* (2013.01); *H01Q 19/10* (2013.01)

(58) Field of Classification Search
CPC ..... H01Q 19/185; H01Q 19/10
USPC ..... 343/753–757, 761, 834, 837, 839, 700
See application file for complete search history.

(56) References Cited

U.S. PATENT DOCUMENTS 3,119,109 A * 1/1964 Miller ..... H01Q 15/22 343/756
3,624,656 A * 11/1971 Kaschak ..... H01Q 3/04 343/762
3,713,038 A * 1/1973 Crimmins et al. ..... H01P 1/208 333/232
4,253,190 A * 2/1981 Csonka ..... B64G 1/1007 244/62
4,298,876 A * 11/1981 Crochet ..... H01Q 19/195 343/756
4,598,276 A * 7/1986 Tait ..... G06K 19/0672 333/167
4,851,858 A * 7/1989 Frisch ..... H01Q 15/0026 343/779
5,148,182 A * 9/1992 Gautier ..... H01Q 3/46 343/701
5,471,223 A * 11/1995 McCorkle ..... H01Q 13/02 343/772

(Continued)

FOREIGN PATENT DOCUMENTS

GB 1360591 A * 7/1974 ..... H03F 3/10

*Primary Examiner* — Bernarr E Gregory
*Assistant Examiner* — Nuzhat Pervin
(74) *Attorney, Agent, or Firm* — Dority & Manning, P.A.

(57) ABSTRACT

A technique is described wherein one or multiple reflectors are integrated into a wideband antenna to provide directional radiation pattern characteristics across the frequency range serviced by the antenna. Distributed filters are designed into the reflector assembly to alter electrical performance as a function of frequency. The directive properties provided by the reflector assembly can be adjusted at specific frequency bands to provide a more or less directive radiation pattern. The reflector assembly is designed to maintain low Passive Intermodulation (PIM) characteristics making the technique applicable to high quality Distributed Antenna Systems (DAS) and other applications which require low PIM levels and/or a radiation pattern that can be controlled as a function of frequency.

18 Claims, 10 Drawing Sheets

(56) References Cited

U.S. PATENT DOCUMENTS 5,767,807 A * 6/1998 Pritchett ..... H01Q 3/24 342/374
6,320,544 B1 * 11/2001 Korisch ..... H01Q 9/0407 343/700 MS
6,335,703 B1 * 1/2002 Chang ..... H01Q 3/20 343/700 MS
6,369,770 B1 * 4/2002 Gothard ..... H01Q 3/446 343/794
6,384,797 B1 * 5/2002 Schaffner ..... H01Q 3/44 343/754
6,396,449 B1 * 5/2002 Osterhues ..... H01Q 3/44 343/754
6,426,727 B2 * 7/2002 Gilbert ..... H01Q 1/42 343/755
6,496,155 B1 * 12/2002 Sievenpiper ..... H01Q 3/26 343/754
6,507,319 B2 * 1/2003 Sikina ..... H01Q 3/04 342/367
6,515,634 B2 * 2/2003 Desclos ..... H01Q 3/12 343/815
6,515,635 B2 * 2/2003 Chiang ..... H01Q 3/242 343/834
6,552,696 B1 * 4/2003 Sievenpiper ..... H01Q 3/44 343/700 MS
6,606,058 B1 * 8/2003 Bonek ..... H01Q 3/26 342/367
6,744,410 B2 * 6/2004 Shamblin ..... H01Q 1/241 343/702
6,753,826 B2 * 6/2004 Chiang ..... H01Q 1/2258 343/834
6,806,843 B2 * 10/2004 Killen ..... H01Q 3/46 343/700 MS
6,943,730 B2 * 9/2005 Poilasne ..... H01Q 1/241 343/700 MS
6,958,738 B1 * 10/2005 Durham ..... H01Q 3/2658 343/700 MS
7,034,761 B2 * 4/2006 Chiang ..... H01Q 1/08 343/745
7,046,965 B2 * 5/2006 Maeda ..... H01Q 1/246 342/367
7,187,338 B2 * 3/2007 Boyle ..... H01Q 1/243 343/770
7,193,574 B2 * 3/2007 Chiang ..... H01Q 19/06 343/757
7,446,712 B2 * 11/2008 Itoh ..... H01Q 13/206 343/700 MS
7,642,961 B1 * 1/2010 Rausch ..... H01Q 1/1242 342/367
7,868,843 B2 * 1/2011 Borau ..... H01Q 1/246 343/700 MS
7,898,476 B2 * 3/2011 Nichols ..... H01Q 1/125 342/359
7,911,402 B2 * 3/2011 Rowson ..... H01Q 1/243 343/745
8,169,356 B2 * 5/2012 Wu ..... G01S 7/36 340/500
8,169,368 B2 * 5/2012 Lorgeoux ..... H01Q 1/1257 342/367
8,223,084 B2 * 7/2012 Tani ..... H01Q 1/243 343/803
8,378,910 B2 * 2/2013 Wolf ..... H01Q 3/24 343/768
8,508,427 B2 * 8/2013 Deng ..... H01Q 3/16 343/839
8,599,087 B2 * 12/2013 Chiang ..... H01Q 1/2266 343/768
8,643,564 B2 * 2/2014 Shimayama ..... H01P 5/028 333/246
8,749,448 B2 * 6/2014 Tsou ..... H01Q 1/243 343/876
8,773,317 B2 * 7/2014 Sakata ..... H01Q 1/521 343/722
8,797,211 B2 * 8/2014 Valdes-Garcia ..... H04B 7/145 342/367
8,855,724 B2 * 10/2014 Bahramzy ..... H01Q 1/245 343/700 R
8,963,779 B2 * 2/2015 Huang ..... H01Q 1/38 343/700 MS
9,276,320 B2 * 3/2016 Wu ..... H01Q 1/243
9,331,397 B2 * 5/2016 Jin ..... H01Q 21/28
2001/0024176 A1 * 9/2001 Cook ..... H01Q 3/2658 343/840
2001/0048351 A1 * 12/2001 Love ..... H01P 1/183 333/156
2003/0034917 A1 * 2/2003 Nishizawa ..... H01Q 1/38 343/700 MS
2003/0137457 A1 * 7/2003 McKinzie, III ..... H01Q 9/0421 343/700 MS
2003/0214451 A1 * 11/2003 Mizuno ..... H01Q 3/18 343/781 P
2004/0061654 A1 * 4/2004 Webb ..... H01Q 21/26 343/754
2004/0080457 A1 4/2004 Chia et al.
2004/0263408 A1 * 12/2004 Sievenpiper ..... H01Q 3/46 343/757
2005/0237265 A1 * 10/2005 Durham ..... H01Q 3/2658 343/909
2006/0038639 A1 * 2/2006 McKinzie, III ..... H01G 4/35 333/219
2007/0018757 A1 * 1/2007 McKinzie, III ..... H01G 4/35 333/219
2007/0262834 A1 * 11/2007 Albacete ..... H01P 1/20381 333/204
2008/0062062 A1 * 3/2008 Borau ..... H01Q 1/246 343/844
2008/0117961 A1 * 5/2008 Han ..... H04B 7/043 375/227
2008/0186244 A1 * 8/2008 Black ..... H01Q 9/28 343/773
2009/0224995 A1 * 9/2009 Puente ..... H01Q 1/246 343/850
2010/0045555 A1 * 2/2010 Ryou ..... H01Q 3/01 343/757
2010/0265009 A1 * 10/2010 Horng ..... H03H 7/0115 333/185
2011/0248799 A1 * 10/2011 Yang ..... H01P 1/20372 333/204
2011/0267156 A1 * 11/2011 Nakamura ..... H01P 1/20345 333/204
2013/0229318 A1 9/2013 Ng et al.
2013/0293321 A1 * 11/2013 Lababidi ..... H01P 1/2039 333/205
2013/0335282 A1 * 12/2013 Leung ..... H01Q 9/32 343/756
2014/0225794 A1 * 8/2014 Choi ..... H01Q 3/01 343/757
2014/0253380 A1 * 9/2014 Choi ..... H01Q 3/24 342/367
2014/0266890 A1 * 9/2014 Schiller ..... H01Q 3/42 342/367
2014/0266955 A1 * 9/2014 Yi ..... H01Q 15/147 343/837
2014/0327577 A1 * 11/2014 Ozaki ..... H01Q 3/26 342/367
2015/0116153 A1 * 4/2015 Chen ..... H01Q 5/22 342/359
2016/0111780 A1 * 4/2016 Yi ..... H01Q 15/147 343/839

* cited by examiner

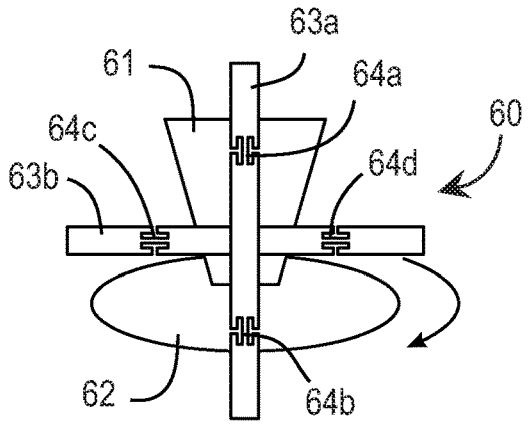
FIG. 6A
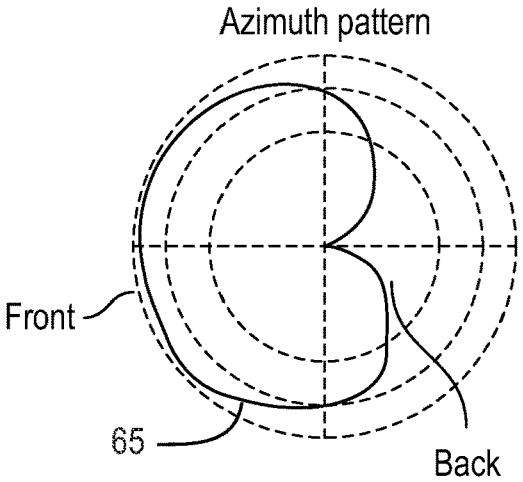
FIG. 6B
FIG. 6C
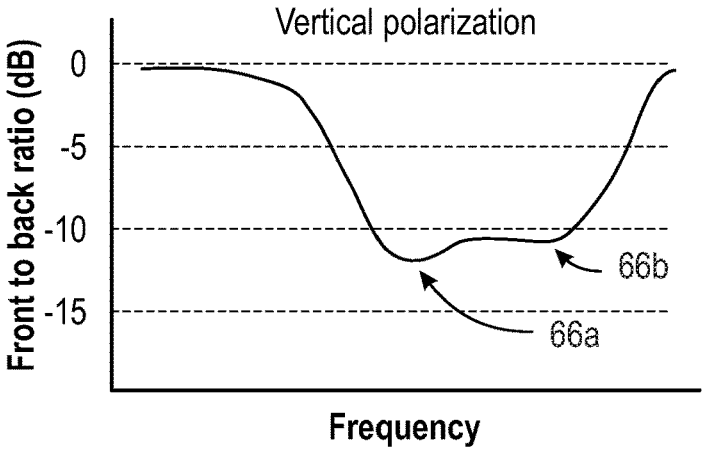
FIG. 6D
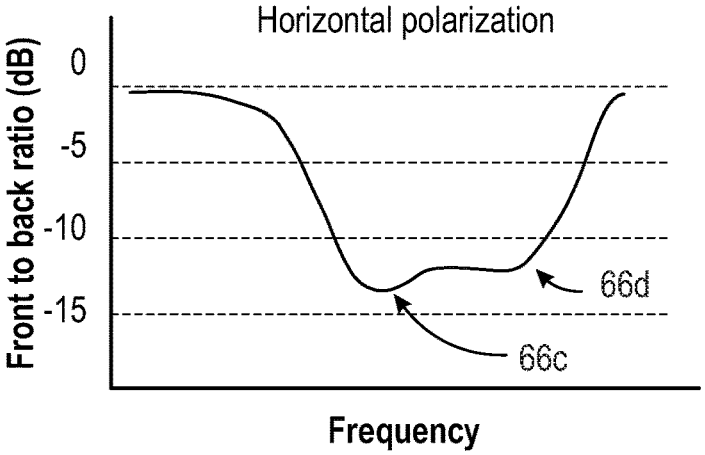

BEAM SHAPING TECHNIQUES FOR WIDEBAND ANTENNA

CROSS-REFERENCE TO RELATED APPLICATIONS

This application relates to U.S. Provisional Patent Application 61/772,434 "BEAM SHAPING TECHNIQUES FOR WIDEBAND ANTENNA", filed Mar. 4, 2013; the contents of which are hereby incorporated by reference.

BACKGROUND OF THE INVENTION

Field of the Invention

This invention relates generally to the field of wireless communication; and more particularly, to distributed antenna systems capable of robust multi-band operation for use in wireless communications.

Description of the Related Art

Continued adoption of cellular systems for data transfer as well as voice communications along with introduction of new mobile communications devices such as Tablet devices make cellular coverage in urban environments a priority. In particular, improving cellular coverage indoors is important to provide a seamless user experience in the mobile communication arena. Distributed antenna systems (DAS) are being installed in office buildings and public areas and are used to provide stronger RF signals to improve the communication link for cellular and data services.

Initial DAS antenna systems were only required to operate over a few frequency bands, making the antenna design process easier. As the communications industry has moved from 2G to 3G cellular systems, and with the advent of 4G communication systems such as Long Term Evolution (LTE), additional frequency bands are required from a DAS antenna system which increases the difficulty in terms of antenna design.

As the density of mobile communication users increases in office buildings and public spaces, and as more users access high data rate features such as file sharing and video downloads, the signal to noise characteristics and RF signal levels of the cellular signals indoors become increasingly important parameters. To maintain low noise floors in communication systems a parameter that is important to address in the antenna design is Passive Intermodulation (PIM). PIM products are generated when two RF signals at different frequencies are injected into an antenna port; the antenna, though being a passive device, can generate spurious responses due to "natural diode" junctions in the antenna. These natural diode junctions can be formed at the junction of two metal surfaces where the metals are dissimilar. Corrosion and oxidation at these junctions can also cause spurious frequency components due to mixing of the two RF signals. Proper antenna design and material selection is important to meet stringent, low PIM requirements. As PIM components increase, these spurious frequency components add to the noise level, which in turn results in reduced signal to noise ratio of the communication system. This will result in reduced data rates for users.

To optimize in-building and outdoor DAS system performance it is desirable to direct or shape the radiated signal such that the radiated or received power at the DAS antenna is directed to or from a specific region or volume. For example, a DAS antenna with omni-directional radiation pattern coverage in the azimuth plane is ideal for mounting on the ceiling in the middle of a room or floor in a building. However, when the omni-directional DAS antenna is positioned in the vicinity of an outer wall or window in an outer wall of the building, it is desirable to shape the radiation pattern of the DAS antenna such that the antenna provide radiation coverage in the interior of the building and minimal radiation outside of the building. A space or volume efficient method of shaping the radiation pattern of a DAS antenna across a wide frequency range is needed to optimize DAS system coverage.

Minimizing radiation external to the building that a DAS system is installed in is important to minimize interference with cellular systems being used for broad area coverage. Ideally, the DAS system will provide good, high signal strength coverage internal to the building being serviced with the DAS system and minimal signal strength external to the building. Additionally, DAS systems installed in adjacent buildings in an urban environment can cause interference between the multiple DAS systems as well as the external cellular system. Better control of the radiation patterns of DAS antennas can help to reduce interference between DAS systems.

Traditional methods of shaping the radiation pattern of an antenna are not applicable to the in-building DAS system due to either 1) narrow frequency band performance from a typical single, small form factor reflector, 2) the large volume required of a traditional parabolic reflector needed to allow for wide frequency coverage, 3) the large volume required from a multi-element reflector assembly such as implemented in a log periodic type antenna, or 4) the inability to maintain a near constant beamwidth or front to back ratio for the radiated pattern over a large frequency range. Antenna size is important for an in-building DAS antenna, with a smaller form factor being more desirable.

SUMMARY OF THE INVENTION

A technique is described wherein one or multiple reflectors are integrated into a wideband antenna to provide directional radiation pattern characteristics across the frequency range serviced by the antenna. Distributed filters are designed into the reflector assembly to alter electrical performance as a function of frequency. The directive properties provided by the reflector assembly can be adjusted at specific frequency bands to provide a more or less directive radiation pattern. The reflector assembly is designed to maintain low Passive Intermodulation (PIM) characteristics making the technique applicable to high quality Distributed Antenna Systems (DAS) and other applications which require low PIM levels and/or a radiation pattern that can be controlled as a function of frequency.

BRIEF DESCRIPTION OF THE DRAWINGS

FIG. 6A illustrates a wideband antenna with a cross shaped reflector positioned in proximity to the radiating element.

FIG. 6B shows a first radiation pattern corresponding to the wideband antenna without a reflector as-illustrated in FIG. 6A.

FIG. 6C shows a plot of front to back ratio with respect to frequency for the antenna of FIG. 6A with vertical polarization.

FIG. 6D shows a plot of front to back ratio with respect to frequency for the antenna of FIG. 6A with horizontal polarization.

DESCRIPTION OF THE EMBODIMENTS

Figure 1:
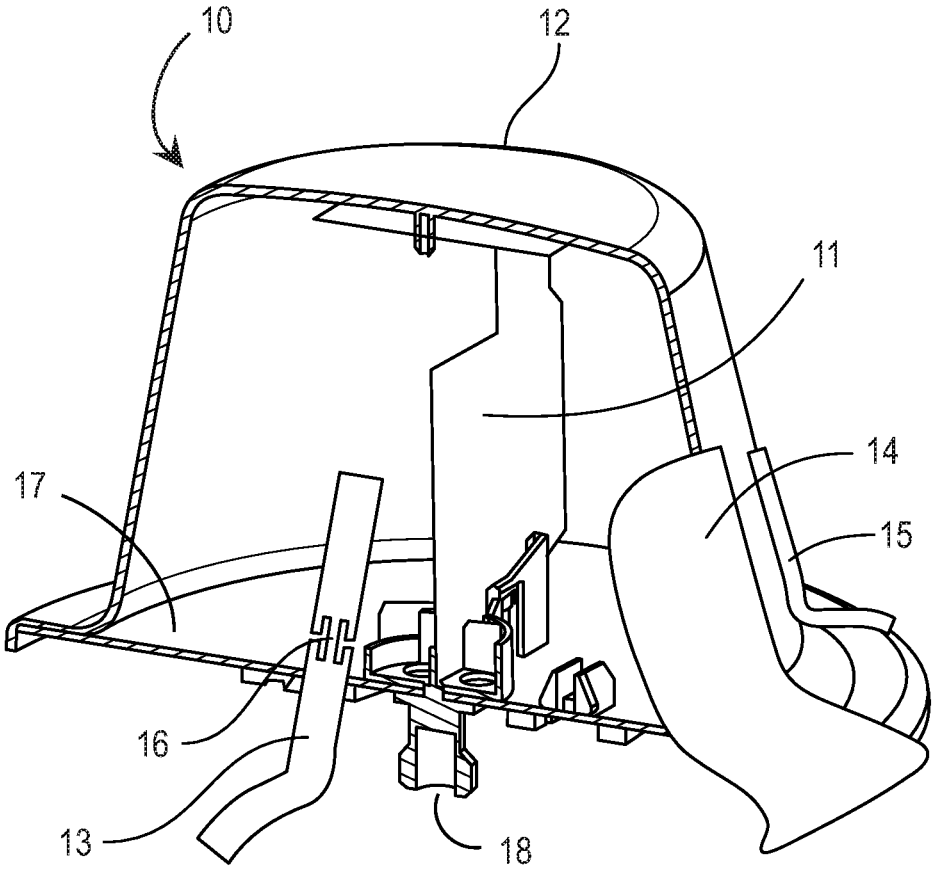
FIG. 1 illustrates a wideband antenna with a three reflector assembly positioned in proximity to the radiating element.

A reflector assembly integrated with a wideband antenna to provide the capability to shape the radiation pattern across multiple frequency bands. One or multiple reflectors in the form of conductors are dimensioned and positioned to shape the radiation pattern of the wideband antenna. Distributed filters are designed into the reflectors to alter the electrical characteristics of the reflector. For example a distributed filter can be designed into a reflector to reduce the electrical length of the reflector as a function of increasing frequency, allowing the length of the reflector to remain optimized as the frequency of operation changes.

In one embodiment of the invention, a first reflector is positioned next to the driven antenna element (or "radiating element") and the length is adjusted to shape the radiation pattern at the lower frequency band that the antenna operates at. A second reflector is positioned at another location in the vicinity of the driven antenna element, with the length of this second reflector adjusted to shape the radiation pattern at the higher frequency band that the antenna operates at. A prior knowledge of the antenna allows for optimal placement of the reflectors to shape the radiation pattern at specific frequencies.

In another embodiment of the invention, a distributed filter is designed into the first reflector. The distributed filter consists of one or more inductive sections and one or more capacitive sections, with these inductive and capacitive sections used to form resonances. The inductive and capacitive sections can be configured to form a band rejection response which can be used to produce a high impedance across a range of frequencies. This high impedance will isolate one region of the first reflector to another, resulting in a reduced electrical length of the first reflector at specific frequencies. The change in electrical length in the first reflector can be used to shape the radiation pattern of the antenna.

In another embodiment of the invention, distributed filters are designed into two or more reflectors in an antenna system to direct the radiation in a specific direction across a wide frequency range.

In another embodiment of the invention, a two dimensional reflector is designed to shape the radiation pattern of an antenna where both co-polarized and cross-polarized radiated components are shaped or directed. A reflector in the shape of a cross can be designed, and distributed filters can be designed into one or both linear arms of the cross shape to provide the ability to generate high impedance sections. These high impedance sections can be used to alter the radiation pattern of one or both radiated polarizations across a wide frequency range.

In another embodiment of the invention, one or multiple components can be used to connect or couple two conductors to form a reflector. The components may include a capacitor, inductor, or resistor, which can be used to alter the impedance of the reflector. Discrete filters can be formed by combining inductors and capacitors to generate band stop, band pass, low pass, or high pass filter sections to alter the impedance of the reflector as a function of frequency. Multiple discrete filters can be integrated into a reflector to provide the ability to change the electrical length of the reflector over multiple steps, resulting better control of the radiation pattern of the antenna across a wide frequency range that the reflector is positioned in proximity to.

In another embodiment of the invention, one or multiple tunable components can be used to connect or couple two conductors to form a reflector. The tunable components may include: a diode, switch, tunable capacitor, field effect transistor (FET), or MEMS device, which can be used to alter the impedance of the reflector. The tunable component can dynamically adjust the electrical length of the reflector, providing in turn dynamic adjustment of the radiation pattern of the antenna the reflector is positioned in proximity to.

Those skilled in the art will appreciate that various embodiments discussed above, or parts thereof, may be combined in a variety of ways to create further embodiments that are encompassed by the present invention.

Now turning to the drawings, FIG. 1 illustrates an example of a wideband antenna system 10 with three reflectors positioned in proximity to the radiating element 11. A first reflector 13 (left-side with respect to the drawing), second reflector 14 (middle) and third reflector (right-side) are shown each positioned adjacent to the radiating element 11. The first reflector 13 includes a distributed filter 16 integrated therein. The radiating element 11 is shown positioned above a ground plane 17. The first through third reflectors can be coupled to a radome 12.

Figure 2A:
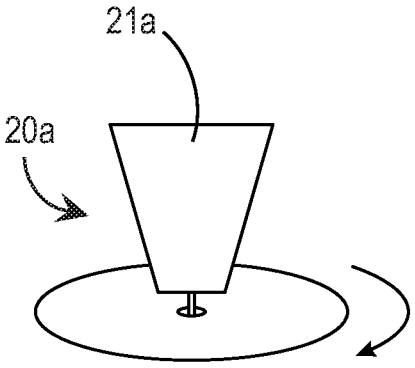
FIG. 2A illustrates a wideband antenna without a reflector in proximity to the radiating element.
Figure 2B:
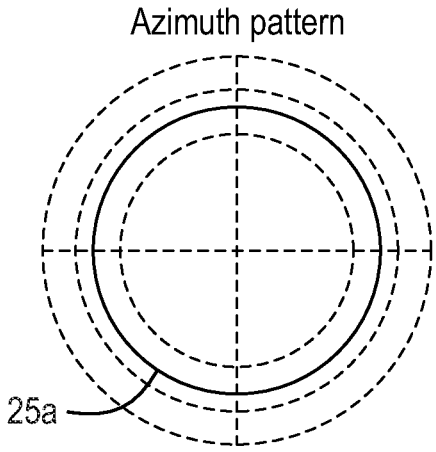
FIG. 2B shows a first radiation pattern corresponding to the wideband antenna 20*a* without a reflector as-illustrated in FIG. 2A.
Figure 2C:
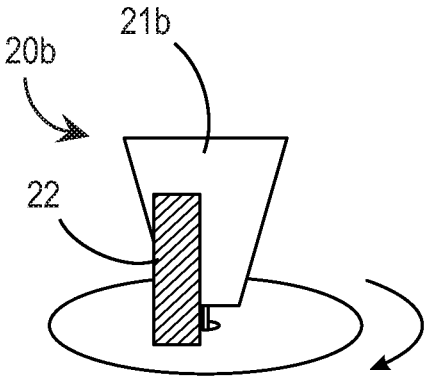
FIG. 2C illustrates a wideband antenna with a reflector in proximity to the radiating element.
Figure 2D:
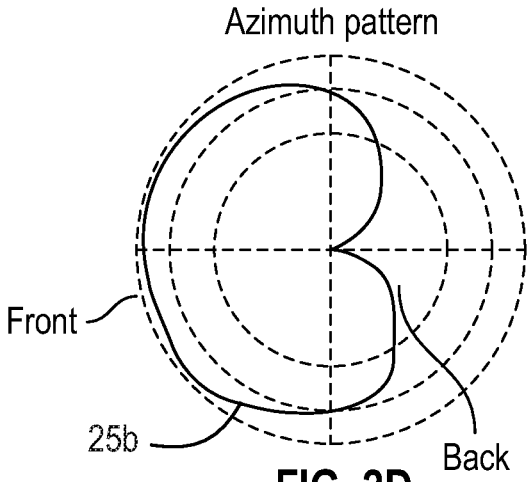
FIG. 2D shows a first radiation pattern corresponding to the wideband antenna with a reflector as-illustrated in FIG. 2C.
Figure 2E:
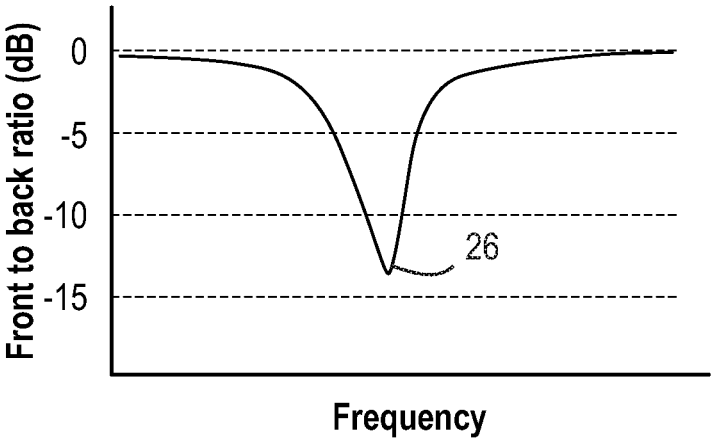
FIG. 2E shows a plot of front to back ratio with respect to frequency of the antenna of FIG. 2C.

FIG. 2A shows an example of a wideband antenna 20*a* including radiating element 21*a* without a reflector. FIG. 2B shows a first radiation pattern 25*a* corresponding to the wideband antenna 20*a* without a reflector as-illustrated in FIG. 2A. FIG. 2C shows an example of a wideband antenna 20*b* with a reflector 22 in proximity to the radiating element 21*b*. FIG. 2D shows a second radiation pattern 25*b* corresponding to the wideband antenna 20*b* with reflector 22; note the reflector acts to reflect the radiated signal. A graph, as shown in FIG. 2E, shows the front to back ratio of the radiation pattern in the azimuth plane for the antenna with reflector (FIG. 2C); note the resonant frequency 26 of the reflector.

Figure 3A:
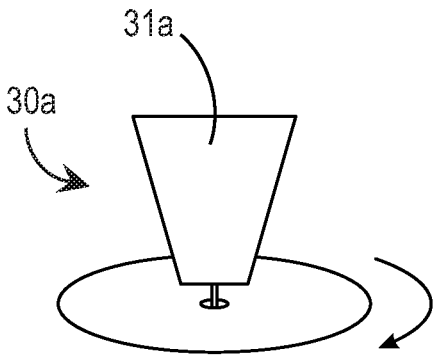
FIG. 3A illustrates a wideband antenna without a reflector in proximity to the radiating element.
Figure 3B:
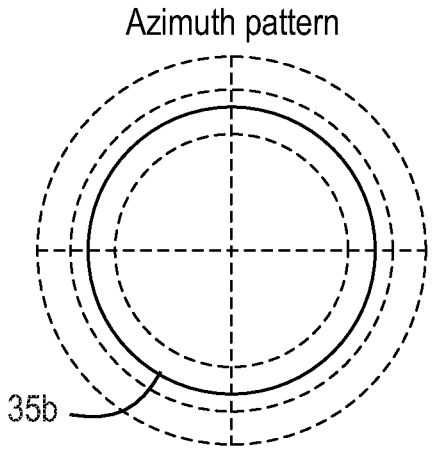
FIG. 3B shows a first radiation pattern corresponding to the wideband antenna without a reflector as-illustrated in FIG. 3A.
Figure 3C:
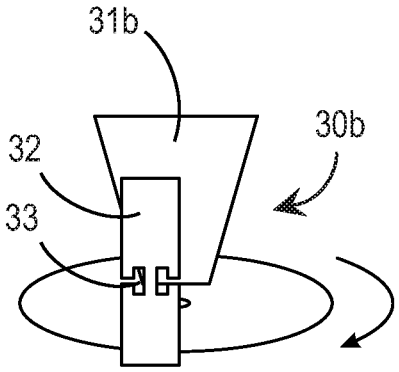
FIG. 3C illustrates a wideband antenna with a reflector in proximity to the radiating element, the reflector includes a distributed filter.
Figure 3D:
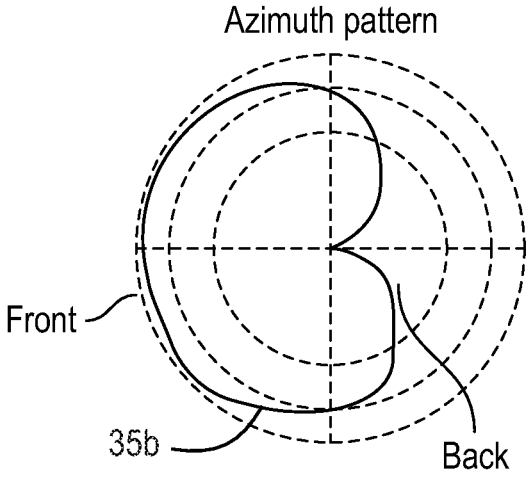
FIG. 3D shows a first radiation pattern corresponding to the wideband antenna with a reflector as-illustrated in FIG. 2C.
Figure 3E:
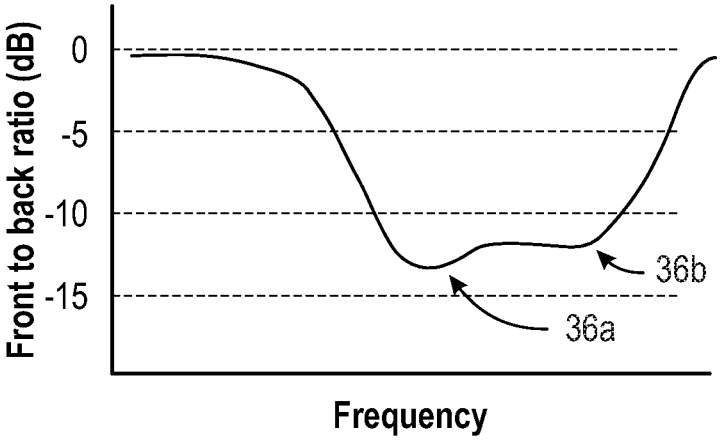
FIG. 3E shows a plot of front to back ratio with respect to frequency of the antenna of FIG. 3C.

FIG. 3A shows an example of a wideband antenna 30*a* including radiating element 31*a* without a reflector. FIG. 3B shows a first radiation pattern 35*a* corresponding to the wideband antenna 30*a* without a reflector as-illustrated in FIG. 3A. FIG. 3C shows an example of a wideband antenna 30*b* with a reflector 32 in proximity to the radiating element 31*b*. The reflector 32 includes an integrated filter 33. FIG. 3D shows a second radiation pattern 35*b* corresponding to the wideband antenna 30*b* with reflector 32; note the reflector acts to reflect the radiated signal. A graph, as illustrated in FIG. 3E, shows the front to back ratio of the radiation pattern in the azimuth plane for the antenna with reflector (FIG. 3C); note the first resonant frequency 36*a* and the second resonant frequency 36*b* of the reflector. The frequency bandwidth of improved front to back ratio is shown for the antenna with reflector with distributed filter (FIG. 3C). This improvement in front to back ratio as a function of frequency is due to the variable electrical length of the reflector provided by the loading effects of the distributed filter.

Figure 4:
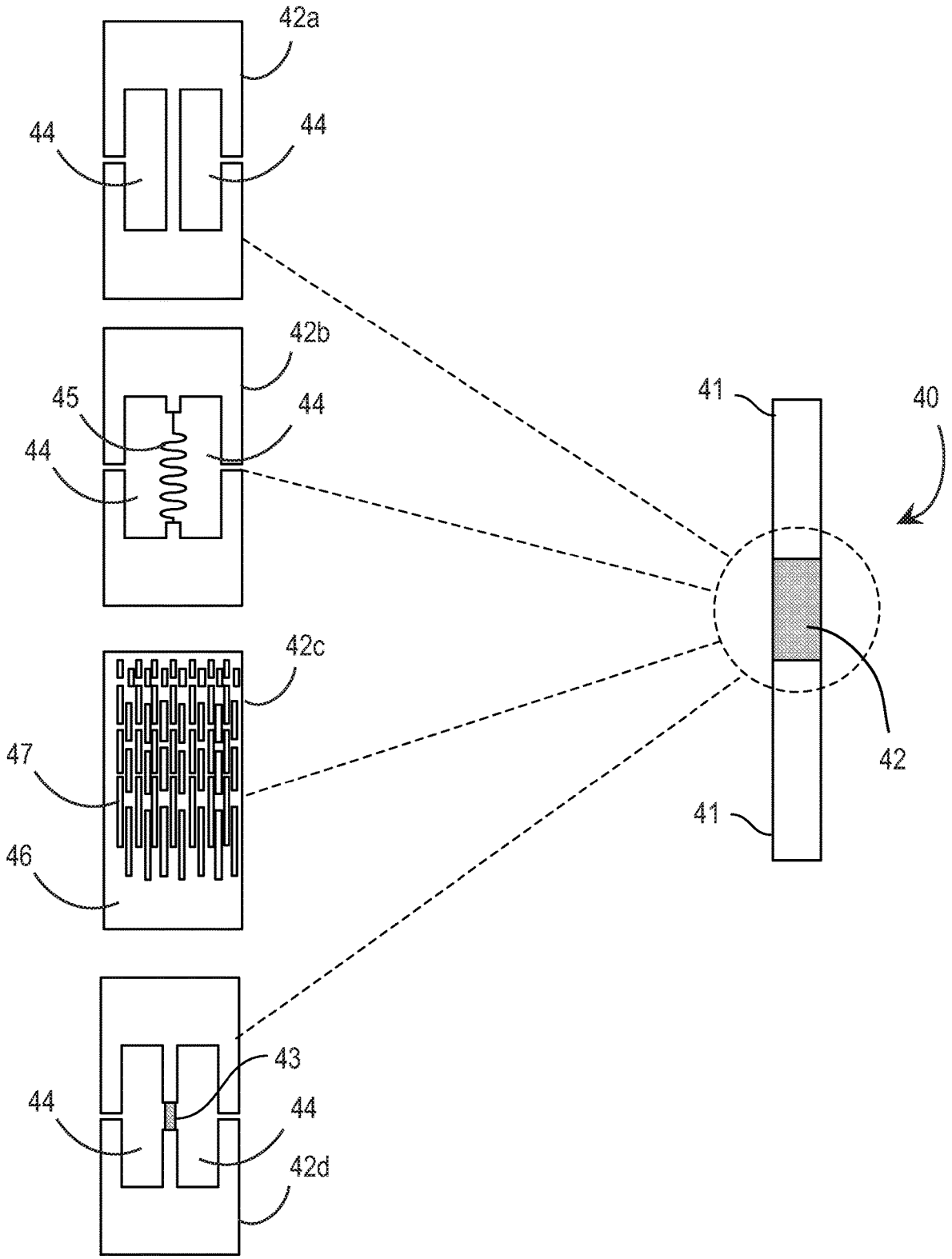
FIG. 4 shows examples of four types of distributed filters that can be integrated into conductors and used as reflectors.

FIG. 4 shows examples of four types of distributed filters that can be integrated into an assembly, the assembly including two conductors 41 and a distributed filter 42 integrated therebetween is used as a reflector with integrated distributed filter. The first distributed filter 42*a* includes a pair of resonant slot regions 44 dimensioned to form an LC circuit; the second distributed filter 42*b* includes a pair of resonant slot regions 44 dimensioned to form an LC circuit where an inductive trace 45 is used to increase inductance; the third distributed filter 42*c* includes a conductive area 46 with an array of slots 47 cut into the conductive area 46; and the fourth distributed filter 42*d* includes a pair of resonant slot regions 44 dimensioned to form an LC circuit where a component 43 is positioned to reactively load the distributed filter. The component 43 may include any resistor, capacitor or inductor, or the like which is known to those having skill in the art.

Figure 5A:
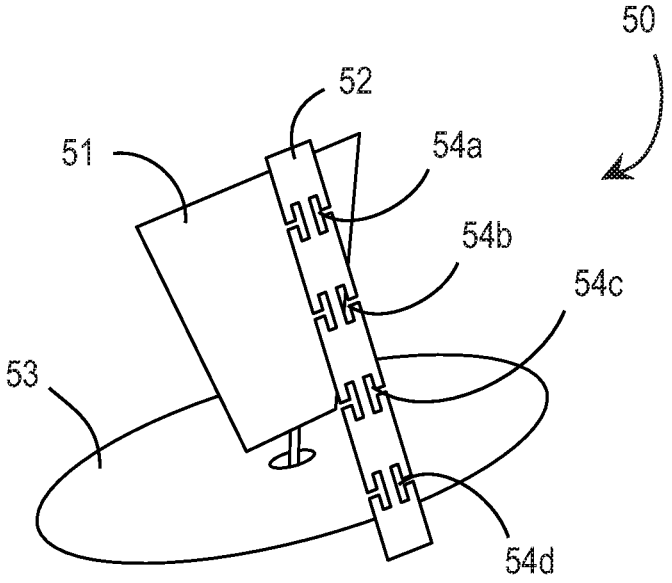
FIG. 5A shows a wideband antenna with a reflector positioned in proximity to the radiating element.
Figure 5B:
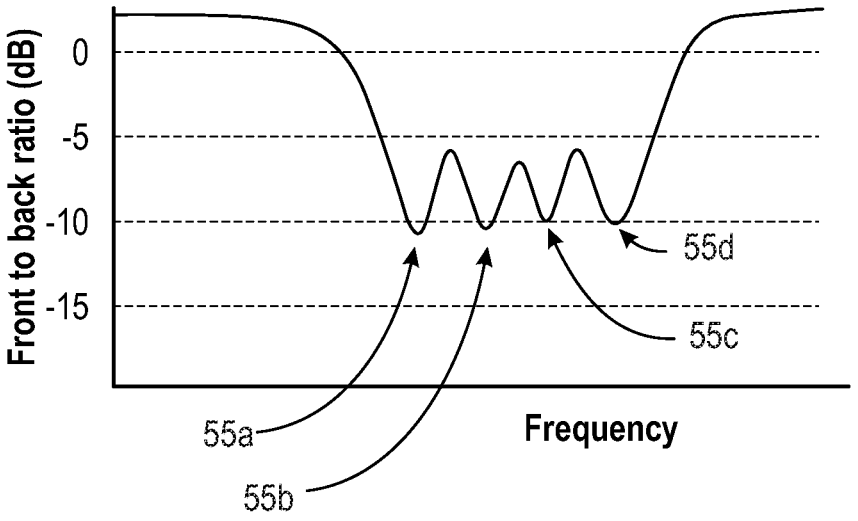
FIG. 5B shows a plot of front to back ratio with respect to frequency for the antenna of FIG. 5A.

FIG. 5A shows a wideband antenna 50 including a radiating element 51 positioned above a ground plane 53, and a reflector 52 positioned in proximity to the radiating element 51. Four distributed filters 54(*a-d*) are integrated into the reflector 52. FIG. 5B illustrates a graph showing front to back ratio with respect to frequency for the wideband antenna of FIG. 5A; note the first resonance of the reflector 55*a*; second resonance of the reflector 55*b*; third resonance of the reflector 55*c*; and fourth resonance of the reflector 55*d*; each of which resulting from one of the distributed filters integrated with the reflector of the wideband antenna.

FIG. 6A illustrates a wideband antenna 60 with a cross-shaped reflector 63, which includes a vertical portion 63*a* and a horizontal portion 63*b*, the cross-shaped reflector is positioned in proximity to a radiating element 61, and the radiating element is positioned above a ground plane 62. Four distributed filters 64(*a-d*) are integrated into the cross-shaped reflector. Azimuth radiation patterns are shown, in FIG. 6B, for the wideband antenna with the cross shaped reflector. FIG. 6C shows a graph illustrating front to back ratio with respect to frequency for vertical polarization of the wideband antenna of FIG. 6A; note the first resonance 66*a* and second resonance 66*b* of the vertical portion of the reflector. FIG. 6D shows a graph illustrating front to back ratio with respect to frequency for horizontal polarization of the wideband antenna of FIG. 6A; note the first resonance 66*c* and second resonance 66*d* of the horizontal portion of the reflector.

Figure 7A:
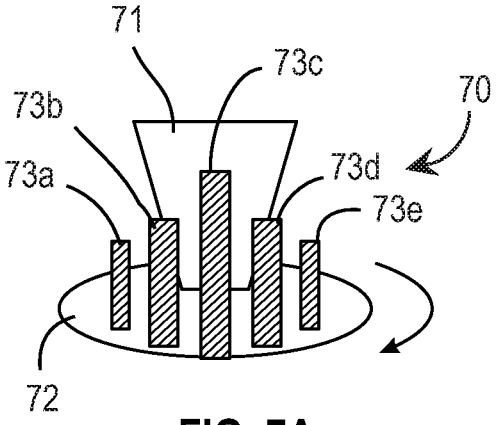
FIG. 7A illustrates a wideband antenna with multiple reflectors positioned in proximity to the radiating element.
Figure 7B:
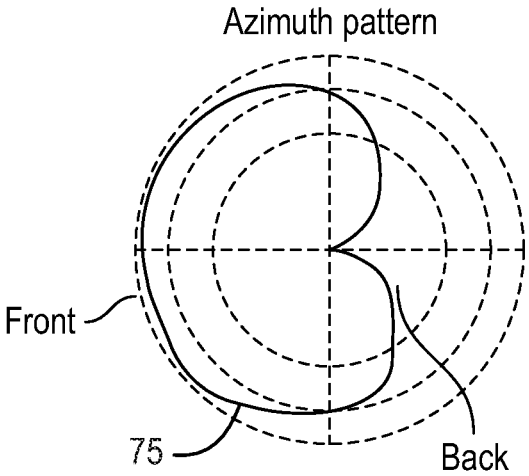
FIG. 7B shows a first radiation pattern corresponding to the wideband antenna without a reflector as-illustrated in FIG. 7A.
Figure 7C:
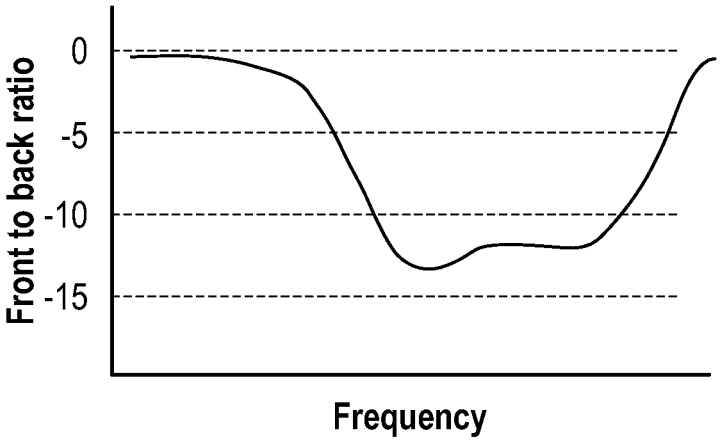
FIG. 7C shows a plot of front to back ratio with respect to frequency for the antenna of FIG. 7A with vertical polarization.
Figure 8B:
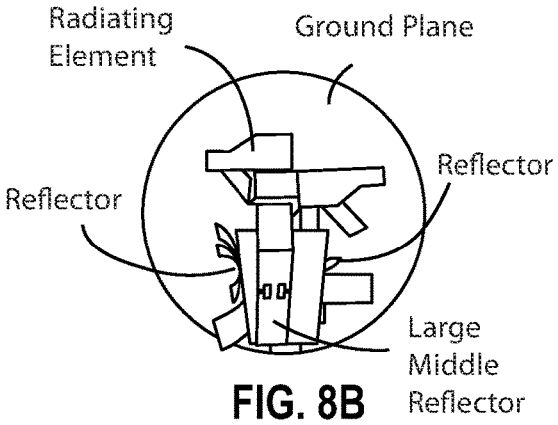
FIGS. 8(A-C) illustrate a practical implementation of a three reflector assembly positioned in proximity to the radiating element of an antenna.
FIG. 8D illustrates various radiation patterns in the azimuth plane for the antenna of FIGS. 8(A-C) at the labeled frequencies.
Figure 8A:
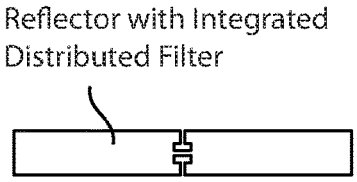
Figure 8C:
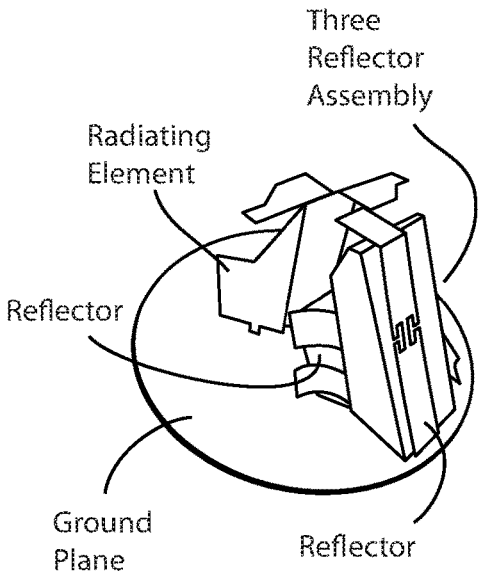
Figure 8D:
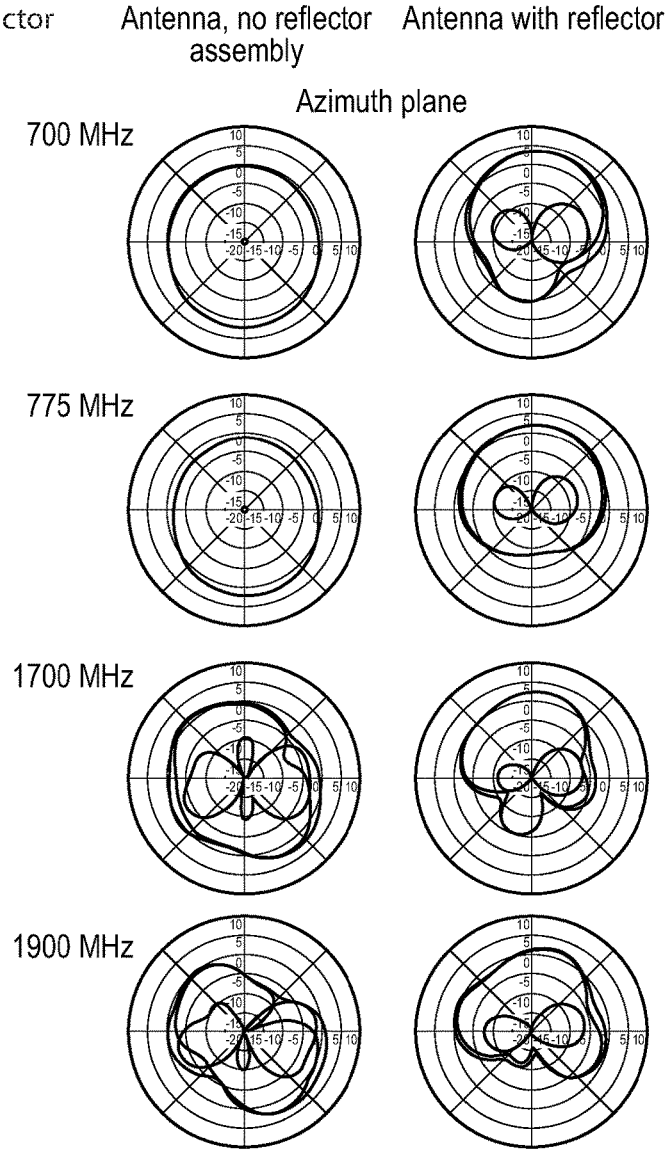

FIG. 7A illustrates a wideband antenna 70 with multiple reflectors 73(*a-e*) positioned in proximity to a radiating element 71, wherein the radiating element is positioned above a ground plane 72. FIG. 7B shows a first radiation pattern 75 corresponding to the wideband antenna 70 as-illustrated in FIG. 7A. A graph, as illustrated in FIG. 7C, shows the front to back ratio of the radiation pattern in the azimuth plane for the antenna with reflectors (FIG. 7A).

FIGS. 8 (A-C) show a practical implementation of a three reflector assembly positioned in proximity to a radiating element of an antenna. A distributed filter (FIG. 8A) is integrated into the large middle reflector as shown in FIG. 8B. FIG. 8D shows the azimuth plane comparing the radiation pattern with and without the reflector assembly shown in FIGS. 8A-8C, as 700 MHz, 775 MHz, 1700 MHz and 1900 MHz.

Figure 9:
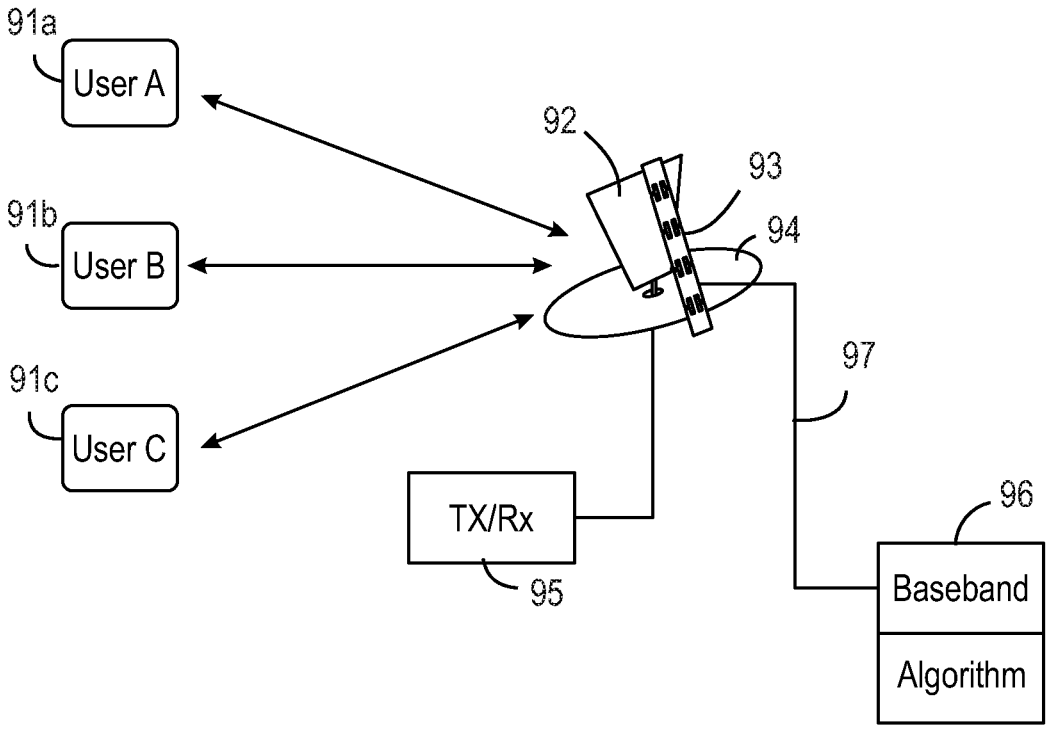
FIG. 9 illustrates a system configuration where control signals can be sent from baseband processor to a reflector assembly with active components integrated into it.

FIG. 9 illustrates a system implementation using dynamic radiation pattern adjustment, where control signals can be sent from a baseband processor 96 to a reflector assembly 93 with active components integrated into it; the reflector ma also be referred to as a "parasitic element" as it forms a parasitic coupling with the radiating element. An algorithm is stored in Baseband and commands the reflector assembly 93 to adjust the radiation pattern of the antenna (radiating element 92 positioned above circuit board 94) to optimally illuminate the users 91*a*; 91*b*; and 91*c* in the communication system. Transceiver 95 is coupled to the radiating element 92.

Figure 10A:
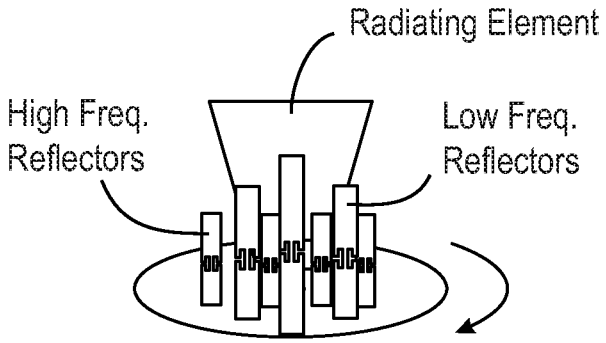
FIG. 10A illustrates a wideband antenna with multiple reflectors positioned in proximity to the radiating element.
Figure 10B:
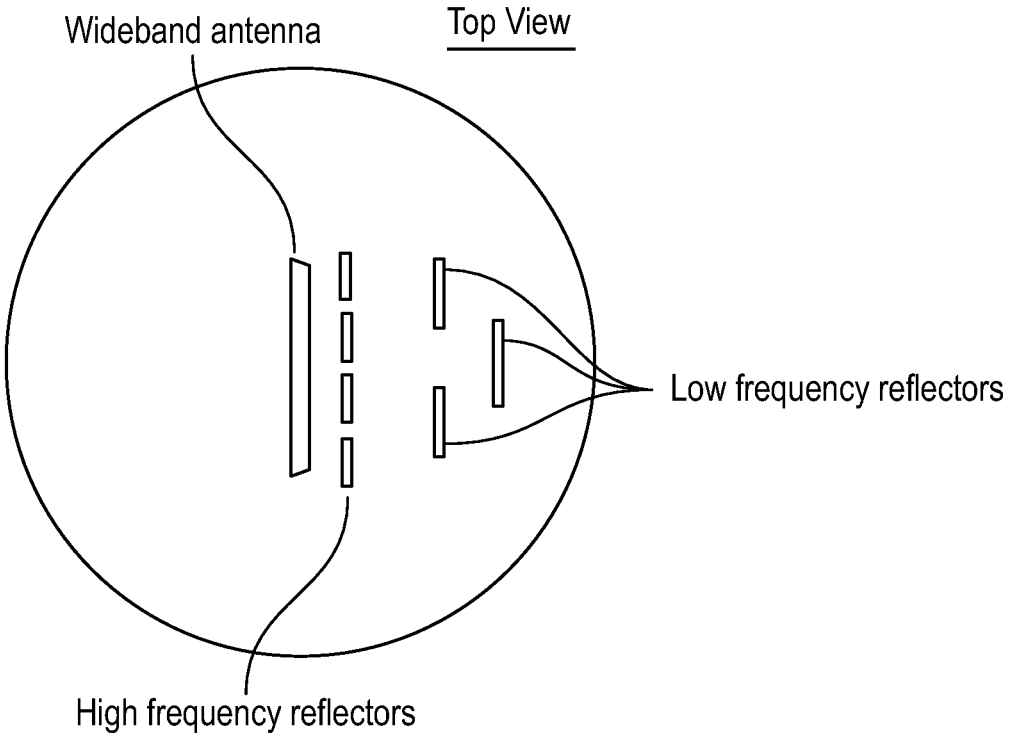
FIG. 10B shows the wideband antenna of FIG. 10A from a top view.

FIG. 10A illustrates a wideband antenna with multiple reflectors positioned in proximity to a radiating element; for example, four high frequency reflectors positioned nears the radiating element, and three low frequency reflectors positioned furthest from the radiating element. The reflectors are displayed in three dimensions and are arranged to optimize the radiation pattern across a wide frequency range. FIG. 10 B shows a top view of the antenna of FIG. 10A; note the arrangement of the reflectors.

We claim:

1. A wideband antenna assembly, comprising:

a radiating element positioned above a ground plane; and a first reflector positioned in proximity to the radiating element, the first reflector being dimensioned to resonate at a first frequency and to reflect power radiated from the radiating element, the first reflector comprising a first distributed filter, the first distributed filter, defining a first resonant slot and a second resonant slot, the first distributed filter further comprising an inductive trace positioned between the first resonant slot and the second resonant slot.

2. The wideband antenna assembly of claim 1, wherein two or more reflectors are positioned in proximity to the radiating element, wherein each of the two or more reflectors are dimensioned to resonate at one or more frequencies and to reflect power radiated from the radiating element.

3. The wideband antenna assembly of claim 1, wherein the first distributed filter is designed to alter the electrical characteristics of the first reflector.

4. A wideband antenna assembly, comprising:

a radiating element positioned above a ground plane;

a first reflector positioned adjacent to the radiating element, the first reflector comprising at least one distributed filter;

wherein the first reflector is configured to reflect power radiated from the radiating element and shape a radiation pattern associated with the antenna assembly, and wherein the at least one distributed filter is configured to alter electrical characteristics of the first reflector;

wherein the at least one distributed filter defines a first resonant slot and a second resonant slot; and wherein the at least one distributed filter further comprises an inductive trace positioned between the first resonant slot and the second resonant slot.

5. The wideband antenna assembly of claim 4, wherein the at least one distributed filter is configured to reduce the electrical length of the first reflector as a function of increasing frequency allowing the electrical length of the first reflector to remain optimized as the frequency of operation of the antenna assembly changes.

6. The wideband antenna assembly of claim 4, the first reflector configured to shape a radiation pattern of the antenna assembly at a first frequency band, the antenna assembly further comprising: a second reflector positioned adjacent to the radiating element, the second reflector configured to shape the radiation pattern of the antenna assembly at a second frequency band, wherein the second frequency band is higher than the first frequency band.

7. The wideband antenna assembly of claim 6, wherein said second reflector comprises a distributed filter integrated therein.

8. The wideband antenna assembly of claim 4 comprising a plurality of reflectors each positioned adjacent to the radiating element, wherein one or more of the plurality of reflectors comprises a distributed filter integrated therein.

9. The wideband antenna assembly of claim 4, wherein the first reflector comprises a cross-shape having a horizontal portion and a vertical portion, and wherein one or more distributed filters are disposed about each of the horizontal and vertical portions.

10. The wideband antenna assembly of claim 4, wherein the first reflector comprises a first conductor portion, a second conductor portion, and a component coupled therebetween.

11. The wideband antenna assembly of claim 10, wherein the component comprises an inductor, capacitor, or resistor.

12. The wideband antenna assembly of claim 10, wherein the component comprises a diode, switch, tunable capacitor, field effect transistor (FET), or MEMS device.

13. The wideband antenna assembly of claim 4, wherein a component is disposed between the pair of resonant slot regions.

14. The wideband antenna assembly of claim 4, further comprising a radome configured to cover at least the radiating element.

15. The wideband antenna assembly of claim 14, wherein the first reflector is coupled to the radome.

16. The wideband antenna assembly of claim 4, wherein the first reflector comprises two or more distributed filters.

17. A wideband antenna assembly, comprising:

a radiating element positioned above a ground plane;

a plurality of first reflectors each positioned adjacent to the radiating element at one or more first distances therefrom, the first reflectors being configured for a first frequency band, a plurality of second reflectors each positioned adjacent to the radiating element at one or more second distances therefrom, the second reflectors being configured for a second frequency band and each comprising a second distributed filter;

wherein the first frequency band is higher than the second frequency band;

wherein the second distances are further from the radiating element than the first distances;

wherein at least one of the first distributed filter and the second distributed filter defines a first resonant slot and a second resonant slot; and wherein the at least one of the first distributed filter and the second distributed filter further comprises an inductive trace positioned between the first resonant slot and the second resonant slot.

18. The wideband antenna assembly of claim 1, wherein the two planar conductive portions are disposed to be coplanar and separated by the first distributed filter.

* * * * *